US007335059B2

(12) United States Patent
Vaccaro

(10) Patent No.: US 7,335,059 B2
(45) Date of Patent: Feb. 26, 2008

(54) COAXIAL CONNECTOR INCLUDING CLAMPING RAMPS AND ASSOCIATED METHOD

(75) Inventor: Ronald A. Vaccaro, Hickory, NC (US)

(73) Assignee: Commscope, Inc. of North Carolina, Hickory, NC (US)

( * ) Notice: Subject to any disclaimer, the term of this patent is extended or adjusted under 35 U.S.C. 154(b) by 0 days.

(21) Appl. No.: 11/682,707

(22) Filed: Mar. 6, 2007

(65) Prior Publication Data

US 2007/0212937 A1 Sep. 13, 2007

Related U.S. Application Data

(60) Provisional application No. 60/745,500, filed on Apr. 24, 2006, provisional application No. 60/780,106, filed on Mar. 8, 2006.

(51) Int. Cl.
*H01R 9/05* (2006.01)

(52) U.S. Cl. ..... 439/578

(58) Field of Classification Search ..... 439/63, 439/578–585

See application file for complete search history.

(56) References Cited

U.S. PATENT DOCUMENTS

| | | | | |
|---|---|---|---|---|
| 3,040,288 | A | 6/1962 | Edlen et al. | |
| 3,963,321 | A | 6/1976 | Burger et al. | 339/177 |
| 5,154,636 | A | 10/1992 | Vaccaro et al. | 439/583 |
| 6,024,609 | A | 2/2000 | Kooiman et al. | 439/675 |
| 6,217,380 | B1 | 4/2001 | Nelson et al. | 439/578 |
| 6,396,367 | B1 | 5/2002 | Rosenberger | 333/260 |
| 6,607,398 | B2 | 8/2003 | Henningsen | 439/578 |
| 6,955,562 | B1 | 10/2005 | Henningsen | 439/578 |
| 2005/0079760 | A1 | 4/2005 | Vaccaro | 439/578 |
| 2005/0118865 | A1 | 6/2005 | Henningsen | 439/578 |

FOREIGN PATENT DOCUMENTS

| | | |
|---|---|---|
| DE | 1075699 | 11/1960 |
| DE | 565981 | 10/1969 |
| FR | 2033463 | 12/1970 |

*Primary Examiner*—Khiem Nguyen
(74) *Attorney, Agent, or Firm*—Allen, Dyer, Doppelt, Milbrath & Gilchrist, P.A.

(57) ABSTRACT

The coaxial cable connector includes a connector housing defining a radially outer ramp portion. The coaxial cable connector may also include an insulator member in the connector housing. The insulator member defines a radially inner ramp portion aligned with the radially outer ramp portion. The coaxial cable connector may include a back nut defining an opposing ramp opposite the outer ramp portion so that the radially inner and outer ramp portions may flare an end of the outer conductor as the coaxial cable is advanced into the connector housing. At least the radial outer ramp portion may cooperate with the opposing ramp of the back nut to clamp the flared end of the outer conductor therebetween.

24 Claims, 4 Drawing Sheets

COAXIAL CONNECTOR INCLUDING CLAMPING RAMPS AND ASSOCIATED METHOD

RELATED APPLICATION

This application is based upon and claims priority to now abandoned provisional application No. 60/780,106 filed Mar. 8, 2006 and to now abandoned provisional application No. 60/745,500 filed Apr. 24, 2006. The entire subject matter of these provisional applications is incorporated herein by reference in its entirety.

FIELD OF THE INVENTION

The present invention relates to the field of cables and connectors, and, more particularly, to a connector for coaxial cables and associated methods.

BACKGROUND OF THE INVENTION

Coaxial cables are widely used to carry high frequency electrical signals. Coaxial cables enjoy a relatively high bandwidth, low signal losses, are mechanically robust, and are relatively low cost. One particularly advantageous use of a coaxial cable is for connecting electronics at a cellular or wireless base station to an antenna mounted at the top of a nearby antenna tower. For example, the transmitter located in an equipment shelter may be connected to a transmit antenna supported by the antenna tower. Similarly, the receiver is also connected to its associated receiver antenna by a coaxial cable path.

A typical installation includes a relatively large diameter cable extending between the equipment shelter and the top of the antenna tower to thereby reduce signal losses. For example, CommScope, Inc. of Hickory, N.C. and the assignee of the present invention, offers its CellReach® coaxial cable for such applications. The cable includes a smooth wall outer conductor that provides superior performance to other cable types. The smooth outer wall construction also provides additional ease of attaching connector portions to the cable ends in comparison to other coaxial cable types, such as corrugated outer conductors, for example.

A typical coaxial cable connector for such a coaxial cable includes a tubular housing or body to make an electrical connection to the outer conductor of the coaxial cable and a center contact to make electrical connection to the inner conductor of the coaxial cable. The center contact may include a tubular rearward end to receive the inner conductor of the coaxial cable. An insulator assembly supports the center contact concentrically within the housing. The insulator assembly may typically include multiple cooperating parts.

A typical connector may also include a gripping member or ferrule that is positioned onto the end of the outer conductor and adjacent the outer insulating jacket portion of the coaxial cable. The ferrule is axially advanced into the housing as a back nut is tightened onto the rearward end of the housing. One or more O-rings may be provided to environmentally seal the connector to prevent the ingress of water, for example, into the connector.

Representative patents directed to coaxial cable connectors include U.S. Pat. No. 6,396,367 B1 to Rosenberger; U.S. Pat. No. 6,024,609 to Kooiman et al.; U.S. Pat. No. 6,607,398 B2 to Henningsen; and U.S. Pat. No. 6,217,380 B1 to Nelson et al. The entire contents of each of these patents is incorporated herein by reference.

One important consideration in reducing the costs of connectors may be the number of connector components that are manufactured and then assembled to produce the connector. Another consideration in connector design may be accommodating the axial movement of the back nut and end of the cable into the connector housing as the back nut is tightened so that good electrical contact is maintained.

Published U.S. Patent application No. 2005/0118865 to Henningsen discloses a coaxial connector including a back nut that threads onto the rear of a connector body. The connector body carries a dielectric spacer at its front end that, in turn, carries a center contact for electrically connecting to the inner conductor of the coaxial cable. The cable end is prepared by manually passing it through the back nut and then manually flaring the outer conductor. The flared portion of the outer conductor is ultimately gripped between a ramp on the rear end of the connector body and a corresponding ramp on the back nut. Unfortunately, flaring the outer conductor requires an additional manual step that needs to be done properly to ensure good contact with the outer conductor.

SUMMARY OF INVENTION

In view of the foregoing background, it is therefore an object of the present invention to provide a coaxial cable connector that provides robust contact to the outer conductor and that may advantageously do away with the additional step of separately manually flaring the outer conductor.

These and other objects, features and advantages in accordance with the present invention are provided by a coaxial cable connector comprising a connector housing defining a radially outer ramp portion, an insulator member defining a radially inner ramp portion aligned with the radially outer ramp portion, and a back nut defining an opposing ramp opposite at least the outer ramp portion. Accordingly, the radially inner and outer ramp portions may flare an end of the outer conductor as the coaxial cable is advanced into the connector housing. In addition, at least the radial outer ramp portion may cooperate with the opposing ramp to clamp the flared end of the outer conductor therebetween to provide effective mechanical and electrical contact.

The back nut may have a gripping surface on an interior thereof for gripping and advancing the coaxial cable into the connector housing as the back nut is tightened onto the connector housing. For example, the gripping surface may comprise a threaded surface.

The radially inner ramp portion may define a smooth continuous ramp surface in some embodiments. The radially outer ramp portion may define a smooth continuous ramp surface in some embodiments, or alternatively the radially outer ramp portion may define a stair-stepped non-continuous ramp surface in other embodiments. Along these lines, the opposing ramp of the back nut may define a smooth continuous ramp surface, or may define a radiused point-contact ramp surface.

The coaxial cable connector may further comprise a contact carried by the insulator member for connecting to the inner conductor of the coaxial cable. The coaxial cable connector may also further comprise at least one sealing ring adjacent the back nut.

Another aspect relates to a method for making a coaxial cable connector for a coaxial cable comprising an inner conductor, a dielectric layer surrounding the inner conductor, and an outer conductor surrounding the dielectric layer.

The method may comprise forming a connector housing defining a radially outer ramp portion and forming an insulator member to be positioned in the connector housing and defining a radially inner ramp portion aligned with the radially outer ramp portion. Additionally, the method may comprise forming a back nut defining an opposing ramp opposite at least the outer ramp portion so that the radially inner and outer ramp portions may flare an end of the outer conductor as the coaxial cable is advanced into the connector housing. At least the radial outer ramp portion may cooperate with the opposing ramp to clamp the flared end of the outer conductor therebetween.

DETAILED DESCRIPTION OF THE PREFERRED EMBODIMENTS

The present invention will now be described more fully hereinafter with reference to the accompanying drawings, in which a preferred embodiment of the invention is shown. This invention may, however, be embodied in many different forms and should not be construed as limited to the embodiments s et forth herein. Rather, these embodiments are provided so that this disclosure will be thorough and complete, and will fully convey the scope of the invention to those skilled in the art. Like numbers refer to like elements throughout and prime and multiple prime notation are used to indicate similar elements in alternative embodiments.

Figure 1:
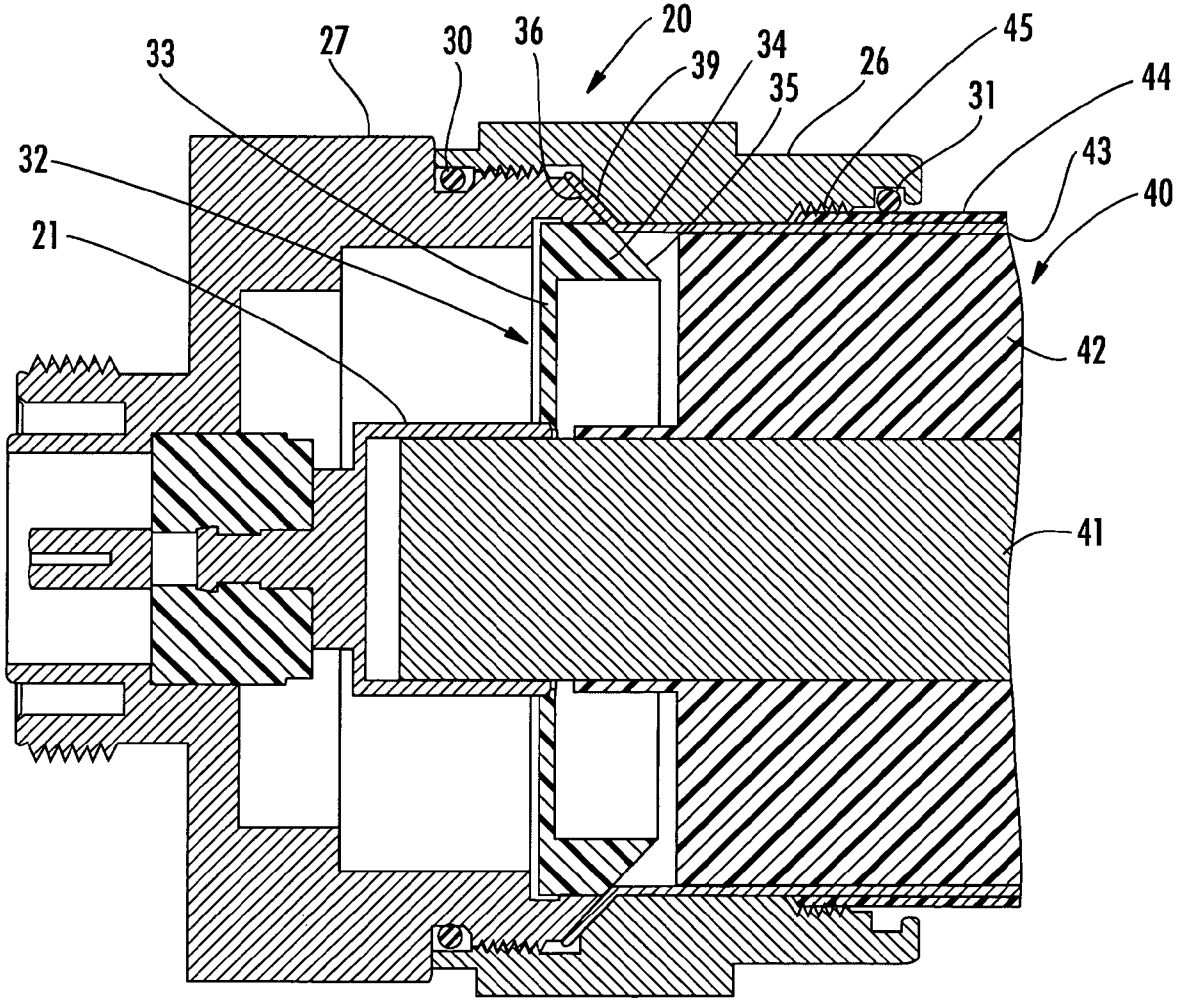
FIG. 1 is a cross-sectional view of a coaxial cable connector installed onto an end of a coaxial cable having a smooth wall outer conductor in accordance with the present invention.

Referring now initially to FIG. 1, the coaxial connector 20 in accordance with the present invention is now described. The connector 20 is installed onto the den of a coaxial cable 40 that illustratively includes an inner conductor 41, a dielectric foam layer 42 surrounding the inner conductor, an outer conductor 43 surrounding the dielectric layer, and an outer insulating jacket 44 surrounding the outer conductor.

The end of the coaxial cable 40 is prepared so that the inner conductor 41 extends axially outwardly beyond the end of the outer conductor 43. In addition, portions of the dielectric foam layer 42 are also removed so that the inner surface of the outer conductor 43 is also exposed. The outer insulating jacket 44 is also stripped back a distance so that outer end portions of the outer conductor 43 are also exposed.

The connector 20 includes an internally threaded back nut 26 threaded onto the externally threaded rearward end of the connector housing 27. A forward Oaring 30 and a rearward 0-ring 31 are provided to seal respective forward and rearward interfaces adjacent the back nut 26 and prevent moisture ingress as will be appreciated by those skilled in the art.

The center contact 21 is illustratively supported in the housing 27 by an insulator member 32. The insulator member 32 includes a forward disk shaped portion 33, and an outer annular portion 34 carried by the disk shaped portion and defining a radially inner ramp portion 35. Along the same line as the radially inner ramp portion 35 there is illustratively provided a radially outer ramp portion 36 defined by the rear surface of the connector housing 27. Opposite the radially inner and radially outer ramp portions 35, 36 there is provided a corresponding opposing ramp 39 formed on the opposing portion of the back nut 26. The forward two ramp portions 35, 36 cooperate with the rearward ramp 39 to self-flare an end of the outer conductor 43. In the illustrated embodiment, the radially outer ramp portion 36 and the opposing ramp 39 clamp an end of the outer conductor 43 therebetween as the back nut is tightened onto the housing 27, as will be appreciated by those skilled in the art. In other embodiments, the radially inner ramp portion 35 may participate in the clamping, as will be appreciated by those skilled in the art. More particularly, the back nut 26 illustratively includes an interior threaded portion 45 that grabs onto or grips the outer jacket 44 of the cable 40 so that as the back nut is tightened onto the housing 27, the outer conductor 43 is advanced, flared, and finally trapped between the ramps as described above.

Figure 2:
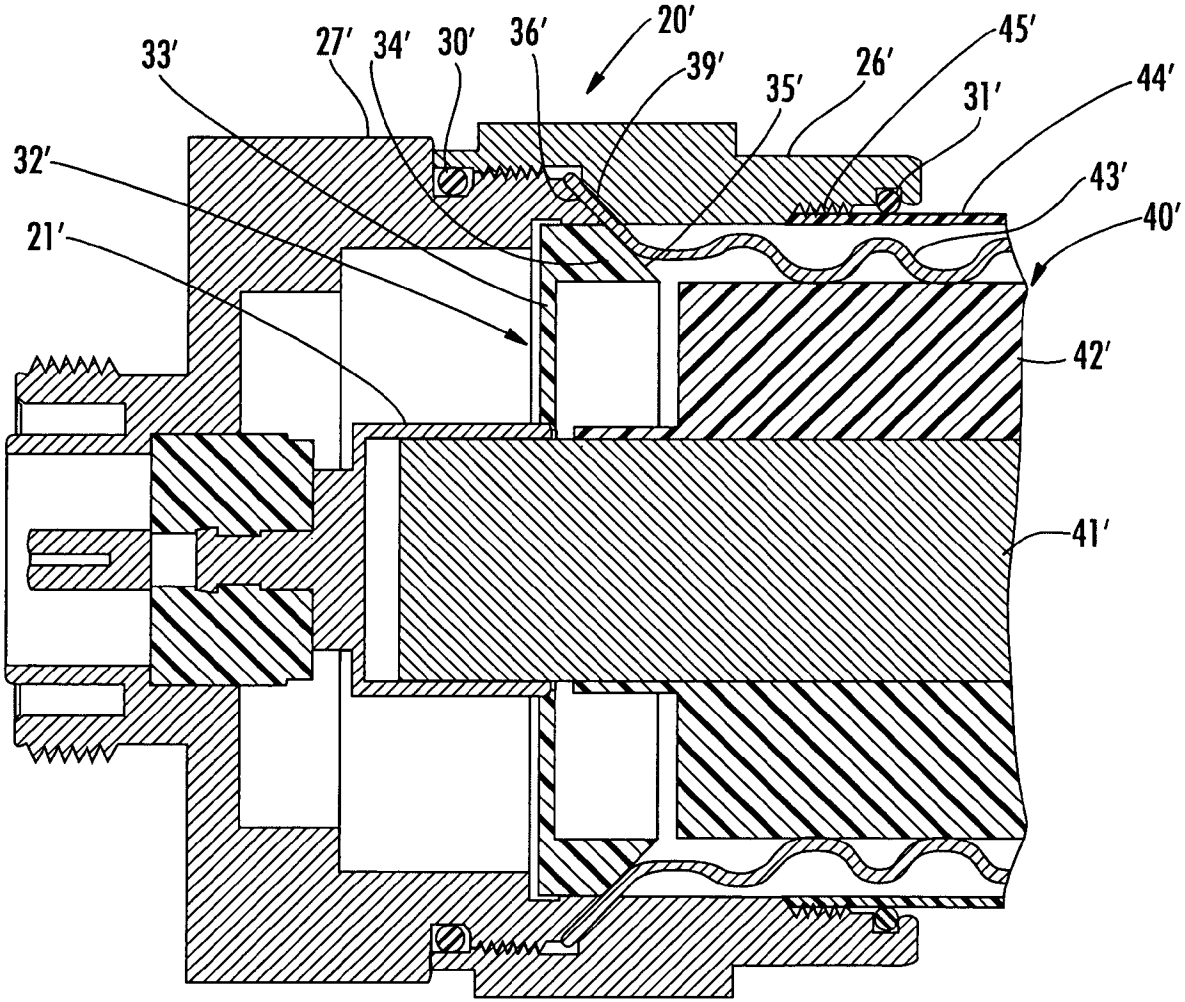
FIG. 2 is a cross-sectional view of the coaxial cable connector as shown in FIG. 1 installed onto an end of a coaxial cable having a corrugated outer conductor.

A second application of a connector 20', including the outer conductor pick-up and self-flaring features is now described with additional reference to FIG. 2. In this application of a connector 20', the coaxial cable 40' includes a corrugated outer conductor 43'. As will be appreciated by those skilled in the art, the corrugated outer conductor 43' includes an alternating series of roots and crests. In accordance with an advantage of the connector 20' the additional ramp length provided by the radially inner ramp 35' and radially outer ramp 36' allow the connector to work without special care to ensure that the outer conductor is cut to reveal a crest, for example, as will be appreciated by those skilled in the art. Those other elements of the connector 20', not specifically discussed, are indicated with prime notation and are similar to elements described above with reference to the connector 20 shown in FIG. 1.

The connectors 20, 20' described above both illustratively include smooth continuous ramp surfaces 35, 36, 39, 35', 36', and 39'. These smooth continuous ramp surfaces may provide adequate mechanical clamping and/or electrical contact for many applications as will be appreciated by those skilled in the art.

Figure 3:
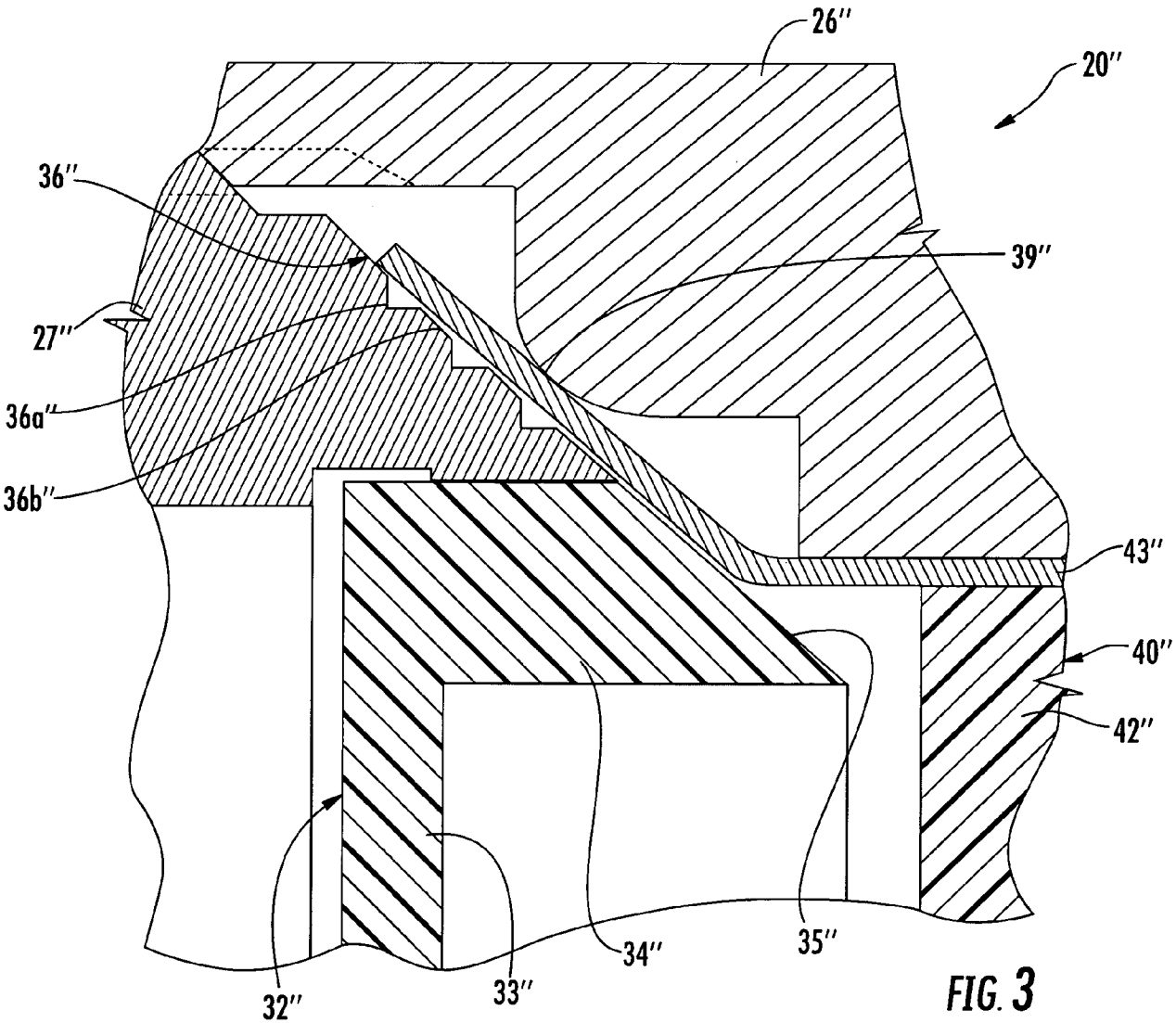
FIG. 3 is an enlarged cross-sectional view of another embodiment of a coaxial cable connector installed onto an end of a coaxial cable in accordance with the present invention.

Referring now additionally to FIG. 3 another embodiment of the connector 20" is now described. In this embodiment, the radially outer ramp 361" defined by the rear surface of the connector housing 27" is illustratively provided by a stair-stepped arrangement including corners **36*a*" separated by alternating flats 36". Of course, this arrangement is but one exemplary embodiment of a class of non-continuous ramp surfaces that may enhance contact with the outer conductor 43"**.

Opposite the stair-stepped ramp 36", the back nut illustratively includes a radiused contact surface 39" instead of the flat or smooth wall contact surfaces defined by the ramps 39, 39' as in the connector embodiments 20, 20' described above with reference to FIGS. 1 and 2. The radiused contact surface 39" is an embodiment of a point contact ramp surface and provides a more localized contact with reduced area, thereby increasing the contact pressure.

As will be readily appreciated by those skilled in the art, the stair-stepped ramp 36" and the radiused contact surface 39", when used individually or in combination, can effectively engage and deform the outer conductor 43" for better mechanical and/or electrical contact. Accordingly, passive intermodulation distortion (PIM) may be reduced in the connector 20". In other words, both PIM performance and PIM stability may be improved.

Those other elements of the connector 20", not specifically discussed, are indicated with double prime notation and are similar to elements described above with reference to the connector 20 shown in FIG. 1 and the connector 20' shown in FIG. 2. Of course, the connector 20" described with reference to FIG. 3, may also be used with a cable having a corrugated outer conductor as will also be appreciated by those skilled in the art.

Figure 4:
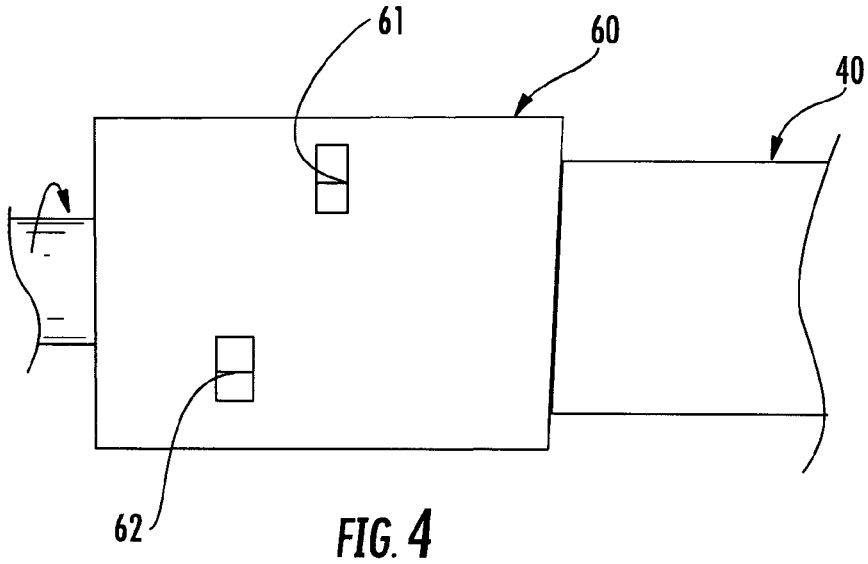
FIG. 4 is a schematic side elevational view of a coring tool as may be applied to an end of a coaxial cable in accordance with the invention.
Figure 5:
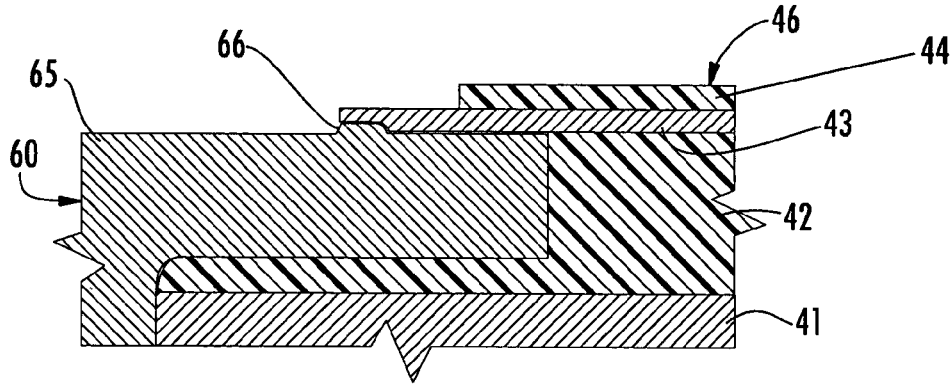
FIG. 5 is an enlarged cross-sectional view of an interior portion of the coring tool shown in FIG. 4.
Figure 6:
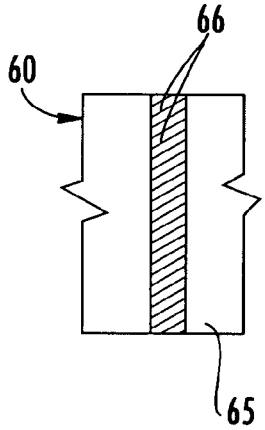
FIG. 6 is a side elevational view of an interior portion of the coring tool shown in FIG. 4.

Referring now additionally to FIGS. 4-6, method aspects and a coring tool 60 for preparing the cable 40 for the various embodiments of connectors 20, 20', 20" are now described. The end of the cable 40 may be prepared using the illustrated coring tool 60 that includes an outer housing 65 that carries two cutting blades 61, 62 to cut and set the length of the outer conductor 43 and outer jacket 44 as will be appreciated by those skilled in the art. The coring tool 60 also includes an interior cutting blade 65 for removing portions of the dielectric layer 42 as perhaps best seen in FIGS. 4 and 5. Moreover, the interior cutting blade also includes a ring of serrated cutters 66 for removing portions of the dielectric material 42 that are adjacent the interior end of the outer conductor 43. The serrated cutters 66 may be angled to help discharged the removed dielectric material as will be appreciated by those skilled in the art. The serrated cutters 66 thus cleanly expose the outer conductor 43 along the portion thereof that will be flared and engaged or clamped between the two ramps as described above.

Yet another method aspect is directed to a method for making the connector 20, 20', 20". The method may include forming a connector housing 27 defining a radially outer ramp portion 36 and forming an insulator member 32 to be positioned in the connector housing and defining a radially inner ramp portion 35 aligned with the radially outer ramp portion. Additionally, the method may comprise forming a back nut 26 defining an opposing ramp 39 opposite at least the radially outer ramp portion 36 so that the radially inner and outer ramp portions 35, 36 may flare an end of the outer conductor 43 as the coaxial cable 40 is advanced into the connector housing 27. At least the radial outer ramp portion 36 may cooperate with the opposing ramp 39 to clamp the flared end of the outer conductor 43 therebetween.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included.

That which is claimed is:

1. A coaxial cable connector for a coaxial cable comprising a inner conductor, a dielectric layer surrounding the inner conductor, and an outer conductor surrounding the dielectric layer, the coaxial cable connector comprising:

a connector housing defining a radially outer ramp portion;

an insulator member in said connector housing and defining a radially inner ramp portion aligned with said radially outer ramp portion; and a back nut defining an opposing ramp opposite at least said radially outer ramp portion so that said radially inner and outer ramp portions flare an end of the outer conductor as the coaxial cable is advanced into said connector housing, and so that at least said radially outer ramp portion cooperates with said opposing ramp to clamp the flared end of the outer conductor therebetween.

2. The coaxial cable connector according to claim 1 wherein said back nut has a gripping surface on an interior thereof for gripping and advancing the coaxial cable into said connector housing as said back nut is tightened onto said connector housing.

3. The coaxial cable connector according to claim 2 wherein said gripping surface comprises a threaded surface.

4. The coaxial cable connector according to claim 1 wherein said radially inner ramp portion defines a smooth continuous ramp surface.

5. The coaxial cable connector according to claim 1 wherein said radially outer ramp portion defines a smooth continuous ramp surface.

6. The coaxial cable connector according to claim 1 wherein said radially outer ramp portion defines a stair-stepped non-continuous ramp surface.

7. The coaxial cable connector according to claim 1 wherein said opposing ramp defines a smooth continuous ramp surface.

8. The coaxial cable connector according to claim 1 wherein said opposing ramp defines a radiused point-contact ramp surface.

9. The coaxial cable connector according to claim 1 further comprising a contact carried by said insulator member for connecting to the inner conductor of the coaxial cable.

10. The coaxial cable connector according to claim 1 further comprising at least one sealing ring adjacent said back nut.

11. A coaxial cable connector for a coaxial cable comprising a inner conductor, a dielectric layer surrounding the inner conductor, and an outer conductor surrounding the dielectric layer, the coaxial cable connector comprising:

a connector housing defining a radially outer ramp portion, said radially outer ramp portion defining a non-continuous ramp surface;

an insulator member in said connector housing and defining a radially inner ramp portion aligned with said radially outer ramp portion; and a back nut defining an opposing ramp opposite at least said radially outer ramp portion so that said radially inner and outer ramp portions flare an end of the outer conductor as the coaxial cable is advanced into said connector housing, and so that at least said radially outer ramp portion cooperates with said opposing ramp to clamp the flared end of the outer conductor therebetween;

said back nut having a gripping surface on an interior thereof for gripping and advancing the coaxial cable into said connector housing as said back nut is tightened onto said connector housing.

12. The coaxial cable connector according to claim 11 wherein said gripping surface comprises a threaded surface.

13. The coaxial cable connector according to claim 11 wherein said radially inner ramp portion defines a smooth continuous ramp surface.

14. The coaxial cable connector according to claim 11 wherein said radially outer ramp portion defines a stair-stepped non-continuous ramp surface.

15. The coaxial cable connector according to claim 11 wherein said opposing ramp defines a smooth continuous ramp surface.

16. The coaxial cable connector according to claim 11 wherein said opposing ramp defines a radiused point-contact ramp surface.

17. A method for making a coaxial cable connector for a coaxial cable comprising a inner conductor, a dielectric layer surrounding the inner conductor, and an outer conductor surrounding the dielectric layer, the method comprising:

forming a connector housing defining a radially outer ramp portion;

forming an insulator member to be positioned in the connector housing and defining a radially inner ramp portion aligned with the radially outer ramp portion; and forming a back nut defining an opposing ramp opposite at least the radially outer ramp portion so that the radially inner and outer ramp portions flare an end of the outer conductor as the coaxial cable is advanced into the connector housing, and so that at least the radially outer ramp portion cooperates with the opposing ramp to clamp the flared end of the outer conductor therebetween.

18. The method according to claim 17 wherein forming the back nut comprises forming the back nut to have a gripping surface on an interior thereof for gripping and advancing the coaxial cable into the connector housing as the back nut is tightened onto the connector housing.

19. The method according to claim 18 wherein the gripping surface comprises a threaded surface.

20. The method according to claim 17 wherein forming the insulating member comprises forming the insulating member so that the radially inner ramp portion defines a smooth continuous ramp surface.

21. The method according to claim 17 wherein forming the connector housing comprises forming the connector housing so that the radially outer ramp portion defines a smooth continuous ramp surface.

22. The method according to claim 17 wherein forming the connector housing comprises forming the connector housing so that the radially outer ramp portion defines a stair-stepped non-continuous ramp surface.

23. The method according to claim 17 wherein forming the back nut comprises forming the back nut so that the opposing ramp defines a smooth continuous ramp surface.

24. The method according to claim 17 wherein forming the back nut comprises forming the back nut so that the opposing ramp defines a radiused point-contact ramp surface.

* * * * *

UNITED STATES PATENT AND TRADEMARK OFFICE

CERTIFICATE OF CORRECTION

PATENT NO. : 7,335,059 B2
APPLICATION NO. : 11/682707
DATED : February 26, 2008
INVENTOR(S) : Ronald A. Vaccaro It is certified that error appears in the above-identified patent and that said Letters Patent is hereby corrected as shown below:

| | |
|---|---|
| Column 3, Line 43 | Delete: "s et"<br>Insert: --set-- |
| Column 3, Line 51 | Delete: "den"<br>Insert: --end-- |
| Column 3, Line 66 | Delete: "Oaring"<br>Insert: --O-ring-- |
| Column 3, Line 67 | Delete: "0-ring"<br>Insert: --O-ring-- |
| Column 4, Line 53 | Delete: "ramp 361" defined"<br>Insert: --ramp 36" defined-- |
| Column 5, Line 31 | Delete: "discharged"<br>Insert: --discharge-- |
| Column 5, Line 60 | Delete: "a"<br>Insert: --an-- |
| Column 6, Line 39 | Delete: "a"<br>Insert: --an-- |
| Column 7, Line 8 | Delete: "a"<br>Insert: --an-- |

Signed and Sealed this

Seventh Day of October, 2008

JON W. DUDAS
*Director of the United States Patent and Trademark Office*